United States Patent [19]

Sieg

[11] Patent Number: 5,038,548

[45] Date of Patent: Aug. 13, 1991

[54] DEFOAMING METHOD AND APPARATUS

[76] Inventor: William F. Sieg, 13 - ½ NE. Fifth St., Minneapolis, Minn. 55413

[21] Appl. No.: 518,630

[22] Filed: Jul. 29, 1983

[51] Int. Cl.[5] ..... B65B 3/22

[52] U.S. Cl. ..... 53/431; 53/237; 53/467; 53/471; 53/474; 53/266.1; 55/87; 55/178; 141/9; 141/70; 141/103; 141/286; 252/321

[58] Field of Search ..... 53/132, 431, 111 R, 53/432, 237, 467, 240, 474, 266 R, 510, 388, 471; 55/87, 178; 141/9, 101, 11, 103, 70, 286; 222/377, 378, 380; 252/321, 361

[56] References Cited

U.S. PATENT DOCUMENTS

| | | | |
|---|---|---|---|
| 1,984,789 | 12/1934 | Everett | 252/361 X |
| 2,669,539 | 2/1954 | Ditman | 252/321 X |
| 2,672,420 | 3/1954 | Jeremiah | 53/432 X |
| 3,561,503 | 2/1971 | Rogge | 141/286 X |
| 4,058,481 | 11/1977 | Futai et al. | 252/321 |
| 4,338,218 | 7/1982 | Spinazzi | 55/178 X |

OTHER PUBLICATIONS

Brochure—"Liquipak 800 Series Former/Filler/Sealers", Liquipak International, Inc., St. Paul. MN.

Brochure—"Liquipak 1200 Series Former/Filler/Sealers", Liquipak International, Inc., St. Paul MN.

Brochure—"Liquipak Model 1400 Former/Filler/-Sealer", Liquipak International, Inc., St. Paul, MN.

*Primary Examiner*—Robert L. Spruill

*Assistant Examiner*—Beth Bianca

[57] ABSTRACT

A method and apparatus for filling an open top carton with a liquid product and liquidating the foam generated during the filling of the carton. A plurality of dispensers sequentially fill the carton with the liquid product. A defoamer introduces a spray of high velocity particles into the foam in the container to break down and liquidate the foam. After the foam is dissipated, the top of the carton is sealed.

20 Claims, 3 Drawing Sheets

DEFOAMING METHOD AND APPARATUS

TECHNICAL FIELD OF INVENTION

The present invention relates to a method and apparatus for filling an open top container with a foamable liquid. In particular the invention relates to method and apparatus for reducing foam produced during filling of a container with a liquid product by spraying a liquid into the container, so that reliable sealing of the top of the container can be achieved.

BACKGROUND ART

Methods and equipment for filling and sealing gable top cardboard cartons with milk, fruit juice and other various liquid food products are well-known. In filling the cartons, the erected cartons are typically transported along a conveyor line from station-to-station. The liquid filling machines have at least two or more stations at which a predetermined amount of the liquid is dispensed at a high rate into the open top of the carton to fill the carton. In the case where there are two stations, typically half the liquid is dispensed at the first station, and the other half of the liquid is dispensed at the second station. After the carton has been filled at the second or final station, the carton is transported along the conveyor to another series of stations where the gable top is formed and sealed. The carton is typically polyethylene coated, so that the sealing of the gable top is done with a combination of heat and pressure.

These liquid filling machines operate at a high production rate, and, therefore, the liquid must be dispensed into the carton rapidly. When the liquid is rapidly discharged into the carton, a foam develops on and over the surface of the liquid. The amount of foam produced during filling depends upon the type of liquid and rate in which the fluid is dispensed from a dispensing nozzle and the particular configuration of the dispensing nozzle. Some configurations of nozzles have more problems than others with foam. However, all dispensing nozzles form some foam within the carton on the surface of the liquid.

The foam becomes a problem when trying to seal a gable top carton or any carton using an adhesive that must be heated before adhesion occurs. The foam can prevent the adhesive from adhering and prevent the gable top from being properly sealed. It is necessary, therefore, to remove excess foam after filling the carton. In the past, a variety of methods have been developed in trying to eliminate the foam within the carton.

One method has been to use a vacuum device, which sucks the foam out of the carton. The vacuum also tends to draw whatever dust, bacteria and other particles that are present in the air over the surface of the liquid food product into the carton. Contamination of the liquid food product as a result of the defoaming process can be a significant problem.

Rydell in U.S. Pat. Nos. 2,792,029 and 2,796,894 shows a tubular vacuum defoamer for milk filling machines. Rydell '029 Patent further includes a beater having blades positioned in the vacuum stream. The beater causes the foam to be directed out on the side wall of the tube so that it is returned to a liquid form and back into the container.

Ward in U.S. Pat. No. 2,753,098 describes another vacuum milk defoaming device wherein the foam is removed by a vacuum defoamer which includes a plate that covers the top of the open container and a vacuum line extending through the plate to suck foam out of the container. The device of the Ward Patent uses a plate to cover the top of the container. In a high production type filling machine, openings between the plate 26 and the top of the container allow dust, bacteria and other particles to be drawn near the surface of the liquid food product in the container.

Burger et al in U.S. Pat. No. 3,169,561 describes an elastic wave generator which directs elastic waves onto the surface of the liquid in the container to break up the foam.

Ullman et al in U.S. Pat. No. 2,752,083 and Wollenwever in U.S. Pat. No. 2,328,372 use a gas that is directed onto the foam to break up the foam. Ullman et al shows a defoaming arrangement in which a high pressure gas, such as air or steam, is directed in a jet onto the surface of the liquid in the carton to break up the foam. Gas nozzles are positioned between liquid discharge nozzles which fill the carton at successive stations. Wollenwever describes the use of a heated gas, specifically steam, which is blown onto the surface of the liquid to break up the foam.

Andre in U.S. Pat. No. 2,604,247 also uses steam which is discharged from a nozzle to assist in removing foam in cooperation with a suction pipe.

McKinnis in U.S. Pat. No. 2,377,796 includes a machine which fills containers with an oxidizable liquid, such as fruit and vegetable juices. Atmospheric air is purged from the container by a jet of inert gas or steam. When the juice is introduced into the container, it is surrounded by a protective blanket of inert gas or steam.

SUMMARY OF INVENTION

The invention resides in a method and apparatus for breaking down or liquidating the foam formed in a container during the filling of a container with a liquid product. According to the method, a predetermined quantity of foamable liquid product is dispensed into the container through the open top thereof. During the dispensing of the liquid product into the container, a foam is generated. The foam rises in the container as the level of the liquid in the container rises. The amount of foam is reduced by breaking down or liquidating the foam in the container with a disruptive substance. This is accomplished by introducing a fine spray of a product into the foam to break down the foam. The foam is dissipated to a level where it does not interfere with the subsequent sealing of the top of the container.

The filling of the container with a liquid product can be accomplished intermittently along a conveyor path. A conveyor moves the container sequentially under a plurality of liquid product dispensing stations. A predetermined portion of the liquid product is dispensed into the container at each of the dispensing stations. A spraying operation can be used intermittently at dispensing stations to break down the foam generated at the dispensing station. In one embodiment of the method of breaking down the foam in a container, the liquid product is dispensed into the container. Simultaneously with the dispensing of the liquid product into the container, a spray of liquid product is introduced into the top of the container. The spray breaks down the foam that is formed during the dispensing operation. In another embodiment, the method of breaking down the foam formed in a container being filled with a liquid product comprises the introduction of a spray of liquid product into an empty open top container. The container is moved to a dispenser which introduces the liquid product into the container. The liquid particles from the spray control the formation or amount of foam that is generated, so that the foam does not interfere with the subsequent sealing of the container.

The apparatus of the invention includes a dispenser means for introducing a liquid product into an open container. A conveyor moves the carton to a defoaming station. A sprayer having a nozzle discharges a fine spray of liquid product into the foam on top of the liquid in the container. The fine spray of liquid product breaks down or liquidates the foam so that it will not interfere with the subsequent sealing of the open top of the container. The liquid product used in the sprayer is a disrupter substance which can include the same liquid product that is being dispensed into the container. The disruptive substance can be other types of liquids and powders that are compatible with the liquid product being dispensed and stored in the container.

The method and apparatus of the invention allows the liquid dispensing machines to be operated at a high production rate. The integrity of the sealing of the carton is increased, notwithstanding the high speed operation of the liquid filling machine. These and other advantages of the method and apparatus of filling an open top container with a foamable liquid product are embodied in the following Specification and Claims.

DESCRIPTION OF PREFERRED EMBODIMENTS

Figure 1:
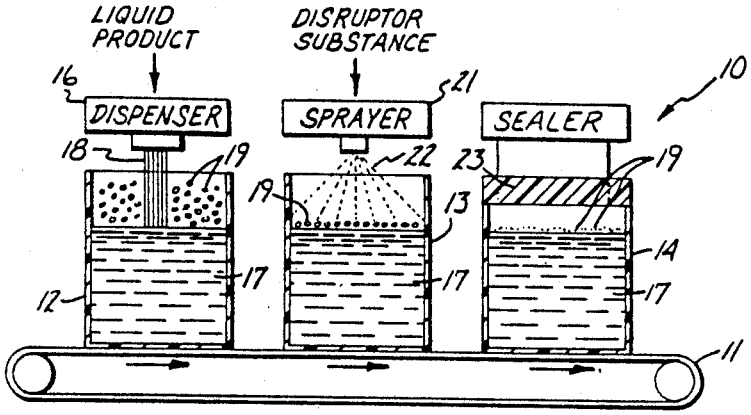
FIG. 1 is a diagrammatic view of the liquid product filling and defoamer method of the invention.

Referring to FIG. 1, there is shown a liquid product filling and defoaming apparatus indicated generally at 10 employing the defoaming method of the invention. Apparatus 10 has a conveyor 11 supporting a plurality of cartons 12, 13, and 14. The cartons are containers for storing liquid product. For example, the cartons can be polyethylene coated boxes used to store milk, fruit juices, and like liquid food products. Bottles, jars, and jugs can be used in lieu of cartons to accommodate the liquid product. The liquid product includes liquids and mixture of liquids and solids that produce foam or bubbles when placed into a container. The products include liquid food products, household liquids, agricultural liquids, industrial liquids, and commercial liquids. A dispenser 16 operates to dispense liquid product 17 into carton 12. Dispenser 16 is a conventional structure, as hereinafter described, operable to discharge a continuous stream 18 of liquid product into carton 12 to fill the carton with a selected amount of liquid product. The rapid introduction of the stream of liquid product into the carton causes foaming or bubbles 19 to form on top of the liquid product. The foam interferes with the filling and the closing or sealing of the carton.

A defoamer comprising a sprayer 21 operates to dispense a spray of finely divided particles 22 into the open top of carton 13. Sprayer 21 is a mechanical structure, such as a piston and cylinder assembly, operable to discharge at relatively high velocity particles 22 into carton 13. Sprayer 21 can be operated with an air cylinder, hydraulic cylinder, or solenoid. The spray of particles 22 breaks up or liquidates foam 19 located on top of liquid product 17 in carton 13. The amount of foam in the carton is reduced so that the top of the carton can be closed by conventional carton closing methods, such as heat sealing. Carton 14 has a closed top 23.

Conveyor 11 operates to sequentially index the cartons under dispenser 16 and sprayer 21. The conveyor 11 can be an indexing table of the conventional liquid product filling machine.

The material of particles 22 is a disrupter which dissipates or liquidates the foam or bubbles 19 on top of liquid product 17. The disrupter is a substance that can be soluble or be insoluble in the liquid product or the foam. The disrupter alters the surface tension of the foam film, resulting in high speed load movements of the foam film that ruptures the foam. The disrupter substance can be alcohol, alcohol and water mixture, water, a water and salt mixture, a powder, or the same liquid product that is stored in the carton. Particles that are soluble in the liquid product go into a solution when they are sprayed into the foam. This changes the surface tension of the foam, causing the foam film to disrupt, since the foam bubble requires a uniform surface tension to be stable. Alcohol is soluble in most liquid products. A spray of alcohol particles into carton 12 will substantially reduce the foam 19 in carton 12. The alcohol will become part of the liquid product.

The reduction of foam 19 increases the productivity of the liquid product filling operation over conventional machines that do not employ a defoaming apparatus. The liquid product can be filled at a faster rate with an existing liquid product filling machine. Apparatus 10 is adaptable to handle liquid food products, such as milk, soft drinks, fruit juices, and the like. The disrupter substance in the form of particles 22 is preferably a portion of the liquid food product. The particles, being sprayed into foam 19 of container 13, are rapidly moving projectiles that break the foam bubbles in the mechanical manner. Particles that are soluble in the liquid product alter the surface tension of the foam and thereby reduce the foam.

Figure 2:
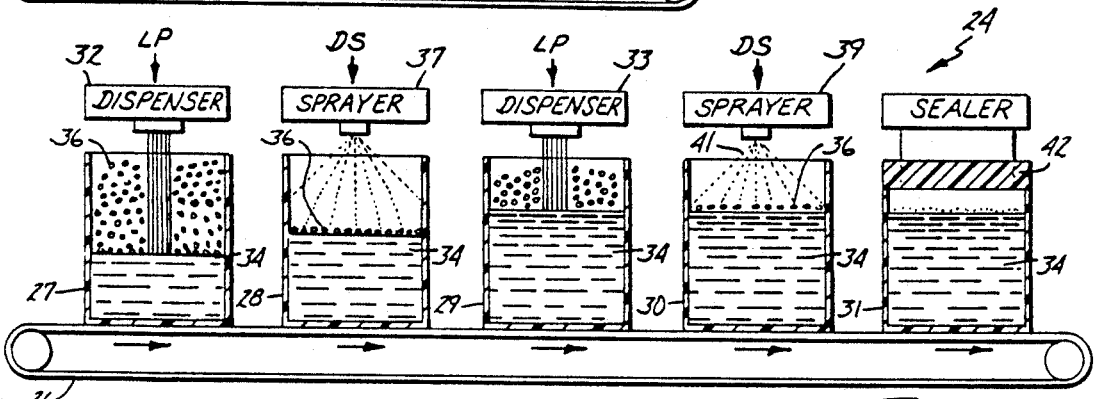
FIG. 2 is a diagrammatic view of a first modification of the liquid product filling and defoamer method of the invention.

Referring to FIG. 2, there is shown a modification of the liquid product filling and defoaming apparatus indicated generally at 24 for sequentially filling cartons with liquid product. The apparatus 24 has a conveyor 26 for moving a plurality of cartons 27, 28, 29, 30, and 31 to selected dispensing and spraying stations and a carton sealing station. Conveyor 26 can be a turntable of a conventional carton filling or bottling machine. Apparatus 24 has a first dispenser 32 and a second dispenser 33 for discharging liquid product 34 into cartons 27 and 29. Dispenser 32 dispenses about one-half of the quantity of liquid product 34 into container 27. The remaining liquid product is placed in the carton with dispenser 33. During the dispensing operation, foam 36 is formed on top of liquid product 34. A first sprayer 37 operates to introduce a disruptive substance DS in the form of fine pressure spray particles 38 into the foam 36. The spray particles 38 suppress and liquidate the amount of foam on top of liquid product 34 in container 28. Container 29 is filled with liquid product 34 on operation of the second dispenser 33. This produces additional foam 36 on top of the liquid product 34. A second sprayer 39 is operable to discharge a disruptive substance in the form of spray particles 41 to further reduce the amount of foam on top of the liquid product 34. Sprayers 37 and 39 can be the same as sprayer 21. The conveyor then moves the last carton 31 to the sealing station. The top of carton 31 is closed at the sealing station.

The use of a plurality of dispensers and sprayers controls the amount of foam that is present in the top of the containers as the cartons move through the liquid product filling and defoaming apparatus. The first and second sprayers 37 and 39 simultaneously function in two separate containers to reduce the foam therein. This allows for the rapid dispensing and filling of the containers and the minimum amount of foam generation.

Figure 3:
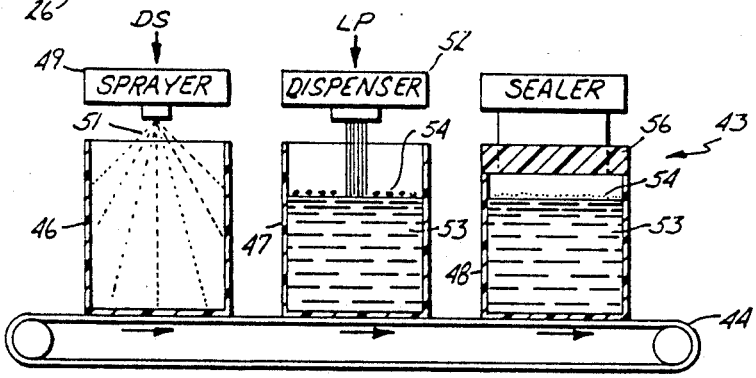
FIG. 3 is a diagrammatic view of a second modification of the liquid product filling and defoamer method of the invention.

Referring to FIG. 3, there is shown a second modification of the apparatus for filling and defoaming a liquid product indicated generally at 43. Apparatus 43 has a conveyor 44 for sequentially moving a plurality of cartons 46, 47, and 48 to sprayer, dispenser, and carton sealing stations. Apparatus 43 has a sprayer 49 operable to discharge a disruptive substance DS in the form of spray particles 51 into the open carton 46. The spray particles 51 in carton 46 form an aerosol or a suspension of particles. Sprayer 49 is the same structure as sprayer 21.

A dispenser 52 operates to discharge a stream of liquid product 53 into carton 47. The aerosol particles in carton 47 operate to minimize the formation of foam 54 on top of liquid product 53. After carton 47 is filled, it moves to the position of carton 48. The top 56 of carton 48 is sealed in a sealing operation. The sealing of carton 48 can be effectively performed, since the amount of foam 54 on top of liquid 53 is nominal.

Figure 4:
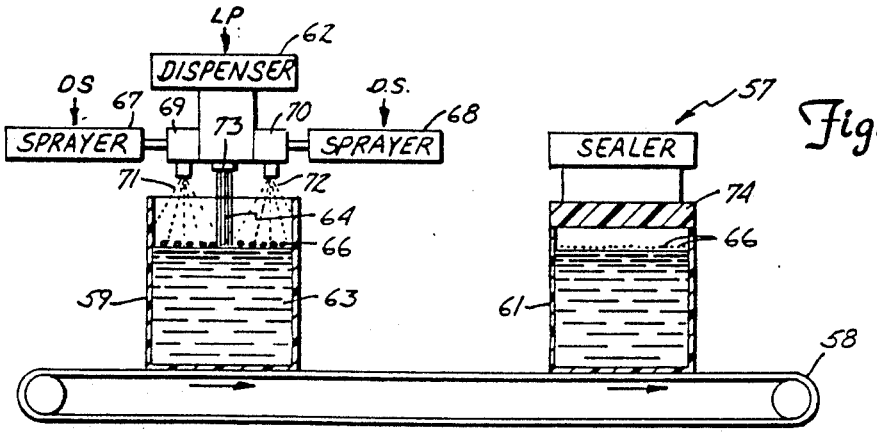
FIG. 4 is a diagrammatic view of a third modification of the liquid product filling and defoamer method of the invention.

Referring to FIG. 4, there is shown a third modification of the liquid product filling and defoaming apparatus of the invention indicated generally at 57. Apparatus 57 has a conveyor 58 for supporting and moving a plurality of cartons 59 and 61 to dispensing and carton sealing stations. The liquid product is dispensed into carton 59 with a dispenser 62 to fill the container with liquid product 63. Dispenser 62 operates to discharge a continuous stream 64 of liquid product, causing a bubbling or foam 66 on top of the liquid product. Simultaneously, with the introduction of liquid product into container 59, a continuous spray of a disruptive substance is introduced into the container to control the foam therein. A pair of sprayers 67 and 68 having nozzles 69 and 70 function to continuously discharge a disruptive substance in the form of spray particles 71 and 72 into the top of the container. Sprayers 67 and 68 can be a single sprayer having one or more discharge nozzles. The discharge nozzles are located about the discharge nozzle 73 of dispenser 62 and function to provide an even distribution of spray particles 71 and 72 into the top of container 59. The particles 71 and 72 break down or liquidate the foam. After the carton 59 is filled, it is moved into the position of the carton 61. The top 74 of carton 61 is sealed.

Figure 5:
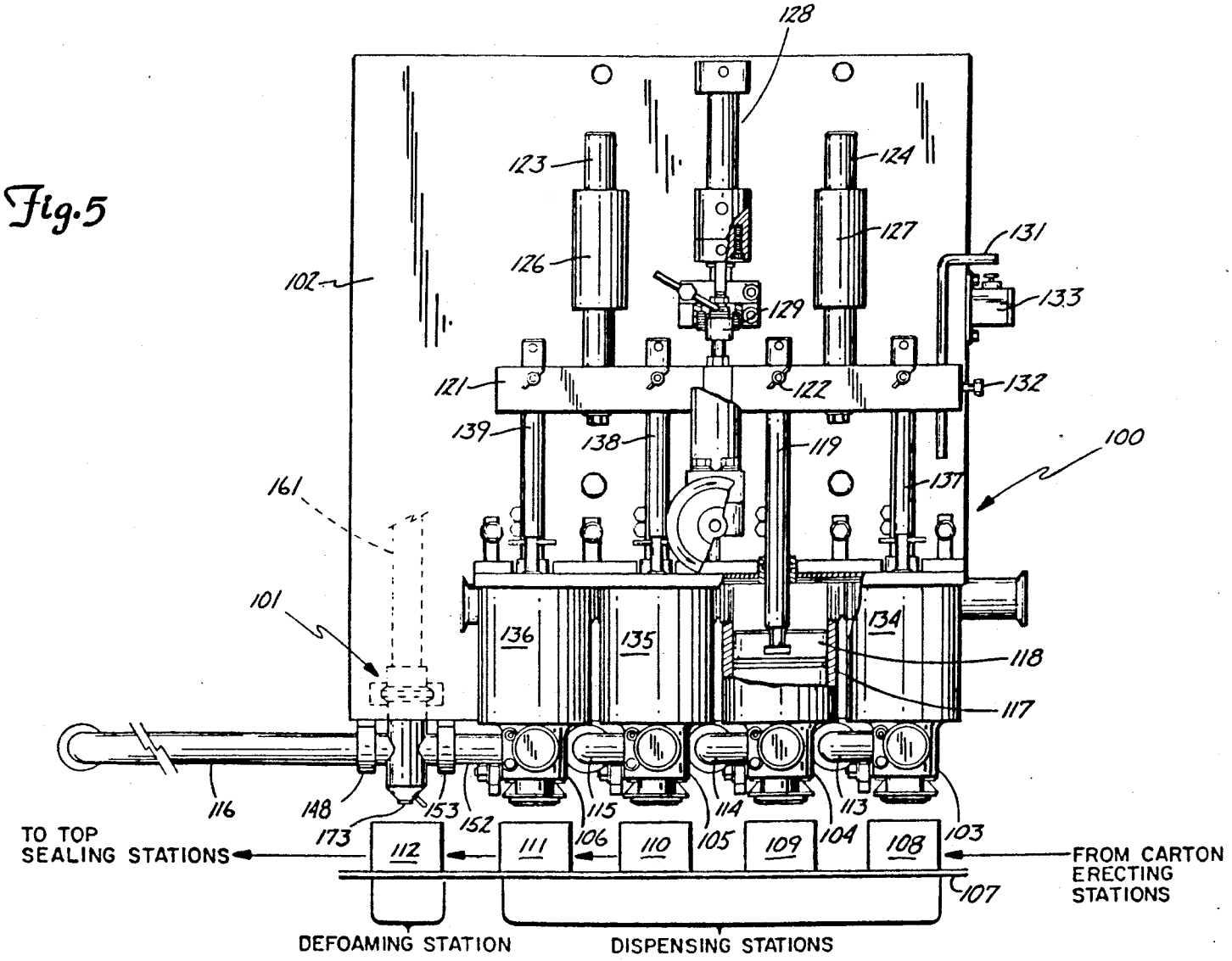
FIG. 5 is a front elevational view of a conventional liquid product filling machine equipped with a defoamer utilizing the method of the invention.
Figure 6:
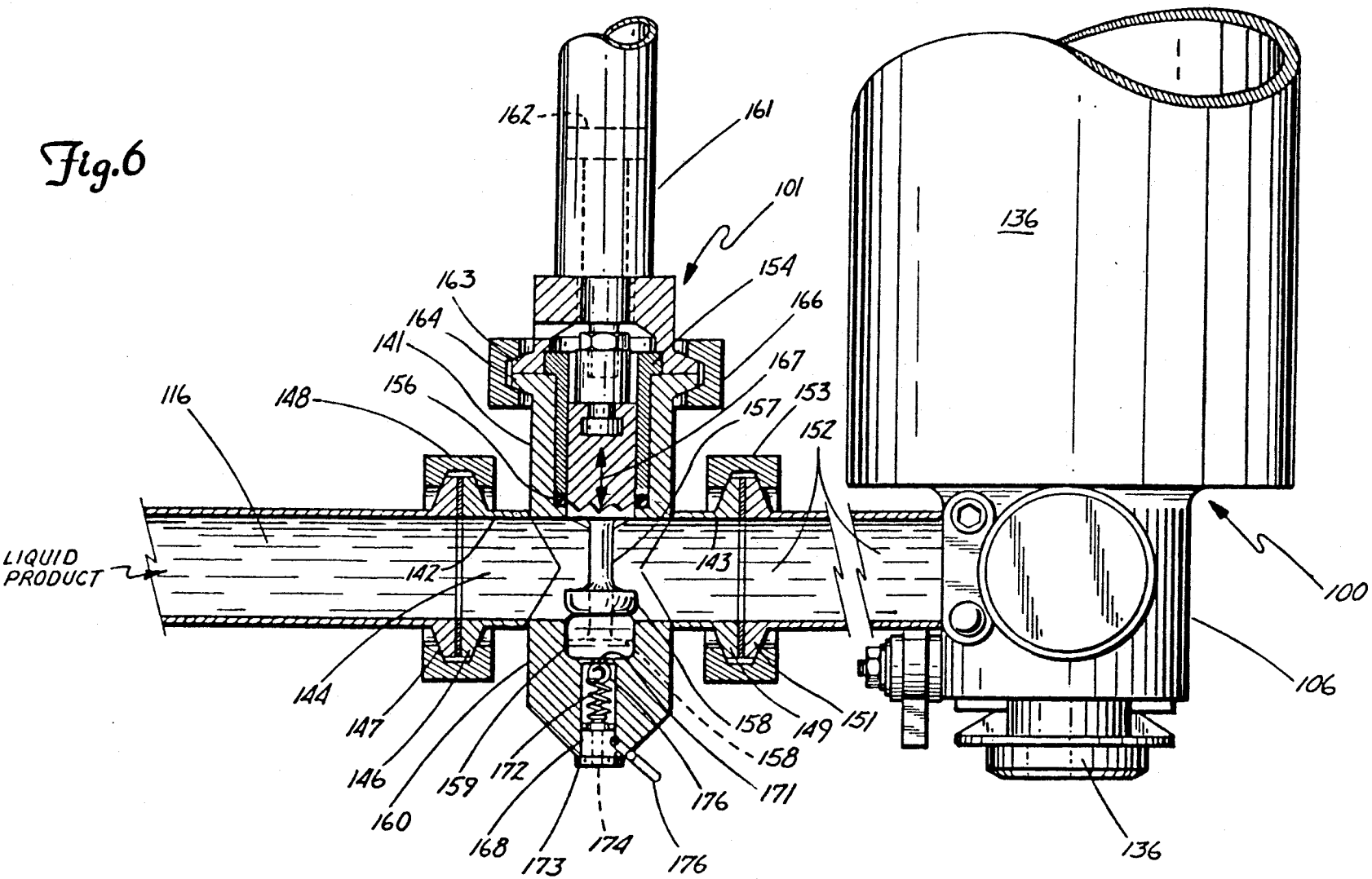
FIG. 6 is an enlarged portion of the machine of FIG. 5, with the defoamer shown in cross section.

Referring to FIGS. 5 and 6, there is shown a conventional liquid filling machine indicated generally at 100 equipped with a defoaming apparatus 101. Machine 100 is part of a carton filling machine that erects flat, collapsed tubular cartons to an upwardly open position and fills the cartons with a liquid food product, such as milk, fruit juices, and the like, and then seals the tops of the filled cartons in a continuous sequential operation. A defoaming apparatus 101 functions to reduce the amount of foam on top of the liquid product in the cartons prior to the sealing of the carton. The method and apparatus embodied in foaming apparatus 101 can be applicable to all types of liquid product filling machines that generate foam when filling an open top carton, container, bottle, or the like with a liquid product.

A conveyor 107 supports a plurality of cartons 108–112 below each of dispensers 103–106 and defoaming apparatus 101. Conveyor 107 can be a turntable or other apparatus for sequentially moving the cartons 108–112 in registration with dispensers 103–106 and the defoaming apparatus 101. Dispensers 103–106 are supplied with a liquid product, such as milk, through a common header pipe connected to a bulk supply tank (not shown). Supply pipes 113, 114, 115, and 116 connect the header pipe to the dispensers 103–106.

Referring to FIG. 5, details of dispenser 104 and its operation are described as follows. Dispenser 103, 105, and 106 have identical structure. A cylinder 117 is located above the dispenser body in alignment with the dispenser nozzle 120. A piston 118 slidably accommodated in cylinder 117 functions to discharge a stream of milk out of nozzle 120 into carton 109. An upright rod 119 is releasably connected to the top of piston 118. The upper end of rod 119 is secured to a cross member 121. A fastener 122, such as a set screw, nut and bolt assembly, and the like, secures rod 119 in an adjusted position relative to cross member 121. Fastener 122 allows rod 119 and piston 118 to be adjusted to change the stroke of piston 118. Cross bar 121 is movably supported on support 102 for vertical movement with a pair of upright posts 123 and 124 slidably accommodated in sleeves 126 and 127. Posts 123 and 124 have bottom ends secured to cross member 121. Sleeves 126 and 127 are secured to support 122.

An upright double-acting air cylinder 128 is connected to the mid-section of cross member 121 with a connector 129. Air cylinder 128 functions to move the cross member 121 in opposite vertical directions and thereby move the piston 118 relative to cylinder 117. When the piston is moved in an upward direction, liquid product is drawn into dispenser 104 and lower end of cylinder 119. When piston 118 is moved in a downward direction, the liquid product is forced through dispenser 104 and nozzle 120 into the carton 109. The air supply to cylinder 128 is controlled with a valve assembly 133 mounted on support 102. A right angle finger 131 secured to cross member 121 with set screw 132 functions to actuate valve assembly 132 when cross member 121 is in its down position. This reverses the flow of air to the air cylinder 128 and returns cross member 121 and piston 118 to its up position. Other types of controls can be used to operate the dispensers.

Dispensers 103, 105, and 106 have piston and cylinder assemblies 134, 135, and 136, respectively, that are connected with upright rods 132, 138, and 139 to the cross member 121. The piston and cylinder assemblies 134, 135, and 136 are identical to the piston and cylinder assemblies 118 and 119 forming part of the dispenser 104.

In use, each dispenser 103–106 discharges a predetermined increment or amount of liquid product into cartons 108, 109, 110, and 111 located in registration with the dispensers. In filling each of the cartons, the first carton 108 is indexed by the conveyor 107 in alignment with dispenser 103. A predetermined amount of liquid product is discharged at a high rate into carton 103 on operation of the air cylinder 128. The conveyor 107 indexes carton 108 to the position of carton 109. A second operation of air cylinder 128 adds a second amount of liquid product to carton 108. The sequence is continued until carton 108 is in the location of carton 111, which fills the carton. The filled carton is then moved by conveyor 107 to the defoaming station in the location of carton 112. This is a conventional operation of a conventional product filling machine having four dispensing stations.

The present invention is used in conjunction with the conventional liquid product dispensing machines and is not concerned with the details of the construction of the dispenser, nor the operation of the machine. The invention is directed to a new method and apparatus for eliminating or liquidating the foam or bubbles that are created on the top of the cartons accommodating the liquid product dispensed by dispensers 103–106 or dispensers of other types of filling machines.

Defoamer 101 functions to break down or liquidate the foam in the filled carton 112. The conveyor 107 indexes the carton 112 under defoamer 101. During the filling operation of dispensers 103–106, the defoamer is operated to liquidate the foam in carton 112. If the foam is not reduced or liquidated, it interferes with the sealing process of the top of the carton. Carton 112 is typically a polyethylene coated cardboard container, which is sealed under heat and pressure. During the filling operation, foam conventionally rises sufficiently high to cause a problem in the sealing of the top of the container. Defoamer 101 sufficiently reduces the amount of foam in container 112 so that it can be sealed without foam interference.

Referring to FIG. 6, defoamer 101 is located in a defoaming station along the conveyor line of conveyor 107 after the last dispensing dispenser 106 and before the sealing station (not shown) where the top of the carton is closed and sealed. Defoamer 101 includes a housing 141 supporting a pair of aligned tubular members 142 and 143 having a common passage 144. Tubular member 142 has an annular outwardly directed flange 146 located adjacent a corresponding annular flange 147 on liquid product supply pipe 116. A clamp 148 releasably connects the flanges 146 and 147. The tubular member 143 has an annular outwardly directed flange 149 located in spaced relationship with an annular flange 151. Flange 151 is on the outer end of supply pipe 152 leading to dispenser 106. A releasable clamp 153 secures flanges 149 and 151 together. The liquid product is free to flow through the supply pipe 116, passage 144, and the pipe 152 to dispenser 106. Defoamer 101 functions to extract a limited supply of liquid from the passage 144 and dispense the liquid, as particles, into carton 112 as a fine high velocity spray of particles.

Housing 141 accommodates an upright sleeve or bushing 154. A plunger piston 156 is slidably located in sleeve 154. The lower end of plunger 156 is slidably located in sleeve 154. The lower end of plunger 156 has an elongated cylindrical neck 157 integral with a head 158. Neck 157 is smaller than passage 144 and is located in the passage 144. Head 158 is located adjacent the top of a cylindrical pocket or recess 159 in the lower end or nozzle 160 of housing 141.

A double-acting air cylinder 161 is releasably connected to the top of piston 156. Cylinder 161 accommodates a reciprocating piston 162 operable to reciprocate plunger 156 in the direction of the arrows 167. Air cylinder 161 is releasably mounted on housing 141 with a releasable connector comprising an outwardly directed annular flange 164 on top of housing 141 and a corresponding flange 163 on the bottom of the air cylinder 161. A clamp 166 releasably secures the flanges 163 and 164 together, thereby mounting the air cylinder 161 on housing 141. Air cylinder 161 can be replaced with a drive mechanism, including a lost motion joined to the cross member 121. This structure will allow the double-acting air cylinder 128 to operate the defoamer 101 in synchronization with the operation of the dispensers 103–106. Other types of drive structures can be used to reciprocate plunger 156 and head 158. The releasable clamps 148, 153, and 166 allow the defoamer housing 144 and mechanism associated therewith to be removed from the dispenser for servicing and cleaning.

Nozzle 160 has a bore 168 open to pocket 159 through a hole 169. A ball check valve 171 normally closes hole 169. A compression spring 172 in engagement with ball valve 171 biases ball valve 171 to the closed position. Spring 172 is supported on a nozzle tip 173 located in the outer end of bore 168. Nozzle tip 173 has a liquid product discharge orifice 174 for directing a spray of liquid product into the top of carton 112. A spring clip 176 releasably holds tip 173 in assembled relation with nozzle 160. The size and shape of orifice 174 determines the spray pattern of the liquid product being dispensed from nozzle tip 173. The liquid pattern can be a conical pattern, or a cross pattern, to accommodate the size and shape of the inside of carton 112. Spring clip 176 allows nozzle tip 173 to be removed for cleaning and replacement with nozzle tips having different types of orifice sizes and shapes.

In use, plunger 156, as shown in solid lines in FIG. 6, is initially in the up position so that, when the pocket 159 fills with liquid product from passage 142. When carton 112 is located below defoamer 101, plunger 156 is pushed down by air cylinder 161. The head 158 is forced into pocket 159. This increases the pressure of the liquid product in pocket 159 opening ball check valve 171. A quantity of liquid product in pocket 159 is forced through the check valve 171 and dispensed through the discharge orifice 174 into the top of the carton 112. The liquid product is under a pressure such that a fine high velocity spray of particles are directed into the foam on top of the liquid product in container 112. This breaks down and liquidates the foam in carton 112.

When plunger head 158 has traveled to its lowermost position in pocket 159, as shown in broken lines, the pocket 158 is empty of liquid product. Spring 172 forces check ball valve 171 to close opening 169. When the head 158 moves out of pocket 159, the liquid product in passage 144 fills pocket 159. Defoamer 101 is in a position to dissipate the foam in the next carton.

Pocket 159 holds a sufficient amount of liquid product to break down or liquidate the foam in carton 112. The amount of liquid product contained in pocket 159 is a minimal quantity in comparison to the total volume of liquid product in carton 112. This volume does not appreciably change the total volume of the liquid product or affect the accuracy of the volume within the container 112. For example, in one embodiment, the volume of pocket 159 is about 0.25 ounces. This is about 1% to 3% of the total of the volume of liquid product in a conventional carton 112. The accuracy of the total volume of liquid product in the carton 112 is not materially changed. Volumetric inaccuracy is economically significant due to a large number of cartons, which are typically filled every day with the liquid filling machine 100. The liquid product dispensed by defoamer 101 is the same liquid product that is dispensed into the containers 108–111. There is no contamination of the carton or dilution of the liquid product.

The present invention has been described with reference to several preferred embodiments and methods of defoaming a liquid product. It is understood that changes in the structures and mechanical details may be made by those skilled in the art without departing from the invention. The invention is defined in the following claims.

The embodiments of the invention in which an exclusive property or privilege are claimed are defined as follows:

1. A method of filling an open top container with a foamable liquid product comprising: dispensing a quantity of a foamable first product into the container generating a foam in said container, and discharging a limited selected quantity of second product particles into the opentop of the container, said dispensing of a first liquid product into the container and the discharging of the second product particles into the container is concurrently accomplished to break down the foam in said container so that the foam will not interfere with subsequent closing of the top of the container, said second product particles being the same as the first product and having a minimal quantity in comparison to the total volume of the product in the container.

2. The method of claim 1 wherein: said dispensing comprises the dispensing of a first quantity of a first liquid product into the container through the open top thereof, discharging a first quantity of second liquid product particles into the container to dissipate the foam located therein, dispensing a second quantity of the first liquid product into the container to fill the container, and discharging a second amount of second liquid product particles into the container to break down the foam so that the foam will not interfere with the subsequent closing of the container.

3. The method of claim 2 wherein: said container has a sealable top which is closed by sealing the top of the container after the foam in the container has been dissipated by the discharging of a second amount of second product particles into the container.

4. The method of claim 1 wherein: said container has a sealable top which is closed by sealing the top of the container after the foam in the container has been dissipated by the discharging of second product particles into the open top of the container.

5. The method of claim 1 wherein: the said product particles are liquid particles.

6. The method of claim 1 wherein: the discharging of the second product particles into the container comprises spraying of the second product particles into the open top of the container.

7. The method of claim 6 wherein: the second product particles are liquid particles.

8. The method of claim 1 wherein: the second product particles comprise milk.

9. A method of filling an open top container with a foamable liquid product comprising: dispensing a predetermined quantity of the foamable liquid product into the container through the open top thereof, said dispensing of the liquid product into the container generating a foam in said container, and discharging a limited selected quantity of a product through the open top of the container before closing the open top of the container, said discharging of a product into the foam and the dispensing of the liquid product into the container is concurrently accomplished to dissipate the foam therein so that the foam will not interfere with the subsequent closing of the top of the container, said discharging of a product into the foam comprises directing a limited quantity of a fine spray of a liquid product into the foam, said fine spray of liquid product being the same as the foamable liquid product and having a minimal quantity in comparison to the total volume of the liquid product in the container.

10. The method of claim 9 wherein: the dispensing of a predetermined quantity of foamable liquid product into the container is accomplished at a plurality of dispensing stations, said method including sequentially moving said container to said plurality of dispensing stations wherein a portion of the predetermined quantity of liquid product is dispensed at each dispensing station into the container.

11. A method of filling an open top container with a foamable liquid product comprising: discharging liquid product particles into the container through the open top thereof, said discharging of product particles into the container comprises spraying of liquid product particles into the container through the open top thereof; and dispensing a quantity of a foamable liquid product into the container, said liquid product being the same as said liquid product particles, said dispensing of the liquid product into the container generating foam in said container, said dispensing of a first liquid product into the container and the spraying of the second liquid product particles into the container is concurrently accomplished, said foam being broken down by the liquid product particles discharged into the container so that the foam will not interfere with subsequent closing of the top of the container.

12. The method of claim 11 wherein: the discharging of product particles into the container comprises spraying of liquid product particles into the container through the open top thereof.

13. An apparatus for filling an open top container with a foamable liquid product comprising: first means for dispensing a predetermined amount of a foamable liquid product into the container, said dispensing of said liquid product into the container generating a foam therein, and second means for discharging a limited selected quantity of liquid product particles into the foam in the container to break down the foam so that the foam will not interfere with the subsequent closing of the open top of the container, said liquid product being the same as said liquid product particles, said second liquid product particles having a minimal quantity in comparison to the total volume of liquid product in the container, said second means including spray means for discharging said liquid product particles into the foam in the container, said spray means being located adjacent said first means for dispensing a predetermined amount of foamable liquid product into the container, said spray means operable to discharge said liquid product particles simultaneously into the container with the dispensing of the foamable liquid product into the container whereby said liquid product particles breaks down the foam in the container.

14. In a liquid dispensing apparatus in which an open top sealable container is conveyed along a conveyor path to at least one dispensing station where a liquid product is discharged into the container through the open top and subsequently conveyed to at least one sealing station at which an open top is sealed, the improvement comprising: means for dissipating the foam in said container positioned at a defoaming station along the conveyor path between the dispensing station and the sealing station, said means having spraying means for directing a limited selected quantity of a spray of a liquid product into the container through the open top, said spraying means directs a spray of a liquid product into the container concurrently with the filling of the container with the liquid product to break down foam within the container, said liquid product being the same as said liquid product particles, said liquid product particles having a minimal quantity in comparison to the total volume of liquid product in the container, said foam being generated at the dispensing station so that any remaining foam in the container will not interfere with the sealing of the top of the container at the top sealing station.

15. An apparatus for filling an open top container with a foamable pasteurized liquid food product from a supply source, the apparatus comprising:

means connected to the supply source for discharging a predetermined amount of the foamable pasteurized liquid food product into the container;

a supply conduit for supplying the pasteurized liquid food product connected to the supply source;

a housing having a chamber communicating with the supply conduit and being a predetermined size sufficient to hold a predetermined quantity of the same pasteurized liquid food product sufficient to break down the foam while not adding significantly to a volume of the pasteurized liquid food product within the container;

a spray nozzle positioned below the chamber in the housing for spraying the predetermined quantity of the pasteurized liquid food product on the foam so that the foam will not interfere with subsequent sealing of the open top of the container;

valve means positioned in a fluid passage between the chamber and the spray nozzle for controlling the flow of the pasteurized liquid food product therebetween; and plunger means for forcing the predetermined quantity of the pasteurized liquid food product from the chamber and cooperating with the valve means such that the pasteurized liquid food product is forced through the spray nozzle to produce the fine spray.

16. The apparatus of claim 15 wherein: the means connected to the supply source for discharging said liquid food product into the container includes a liquid food product dispenser located above the open top container to be filled with liquid food product, said dispenser operable to discharge liquid food product into the container through the open top thereof, said liquid food product discharged into the container generating a foam therein, said nozzle directing a fine spray of liquid food product into the container through the open top thereof to break down the foam.

17. The apparatus of claim 15 wherein: the spray nozzle is located above the open top container, said nozzle creating a fine spray of liquid food product and directing the fine spray of liquid food product into the container through the open top thereof breaking down the foam in the container.

18. An apparatus for filling an open top container with a foamable liquid product from a source of supply of said liquid product comprising:

means connected to the source of supply of said liquid product for discharging a predetermined amount of said liquid product into the container through the open top thereof; said discharging of liquid product into the container producing a foam in the container, means for carrying said liquid product from the source of supply of said liquid product to a liquid product dispensing location adjacent the open top of a container having liquid product and foam, a housing having a chamber communicating with the means for carrying said liquid product and being a predetermined size sufficient to hold a predetermined quantity of the same liquid product sufficient to break down the foam within the container while not adding significantly to a volume of the liquid product within the container;

and a spray nozzle means in communicating with the chamber associated with the housing for spraying the predetermined quantity of the liquid product on the foam within the container to break down the foam so that the foam within the container will not interfere with subsequent sealing of the open top of the container.

19. The apparatus of claim 18 wherein: the means connected to the source of supply of said liquid product includes a dispenser located above the open top container to be filled with liquid product, said dispenser operable to discharge liquid product into the container through the top thereof, said liquid product discharged into the container and means to move the container with liquid product and foam to a location below the spray nozzle means, said spray nozzle means directing the spray of liquid product into the foam in the container to break down said foam.

20. The apparatus of claim 18 including: means for controlling the flow of liquid product from the chamber to the nozzle means, and means for forcing liquid product from the chamber through the nozzle means to produce the spray of liquid product directed by the nozzle means into the container to break down the foam in the container.

* * * * *